US012385643B1

(12) United States Patent
Weilert et al.

(10) Patent No.: US 12,385,643 B1
(45) Date of Patent: Aug. 12, 2025

(54) FIRE PIT BARRIER

(71) Applicant: SOLO BRANDS, LLC, Grapevine, TX (US)

(72) Inventors: Jeffrey R. Weilert, Southlake, TX (US); Alexander K. Maghsadi, Fort Worth, TX (US)

(73) Assignee: Solo Brands, LLC, Grapevine, TX (US)

( * ) Notice: Subject to any disclaimer, the term of this patent is extended or adjusted under 35 U.S.C. 154(b) by 0 days.

(21) Appl. No.: 18/759,191

(22) Filed: Jun. 28, 2024

(51) Int. Cl.
*F24B 1/198* (2006.01)
*F24B 1/195* (2006.01)
*F24B 13/00* (2006.01)

(52) U.S. Cl.
CPC ..... *F24B 1/198* (2013.01); *F24B 1/195* (2013.01); *F24B 13/002* (2013.01)

(58) Field of Classification Search
CPC ..... F24B 1/198; F24B 13/002; F24B 1/195
See application file for complete search history.

(56) References Cited

U.S. PATENT DOCUMENTS

| | | | |
|---|---|---|---|
| 500,239 | A | 6/1893 | Loeble |
| 685,194 | A | 10/1901 | Young |
| 904,188 | A | 11/1908 | Engle |
| 1,298,762 | A | 4/1919 | Milligan |
| 1,694,175 | A | 12/1928 | Hauser |
| D100,012 | S | 6/1936 | Ford |
| 2,614,553 | A | 10/1952 | Cox |
| 2,676,583 | A | 4/1954 | Blumson |
| 2,722,883 | A | 11/1955 | Rignell |
| 2,738,225 | A | 3/1956 | Meek |
| D196,018 | S | 8/1963 | Palmer |
| 3,756,218 | A | 9/1973 | Simpson |
| D229,013 | S | 11/1973 | Storandt |
| D229,277 | S | 11/1973 | Chan |
| 3,790,081 | A | 2/1974 | Thornton |
| 3,937,138 | A | 2/1976 | Tidwell |
| 3,951,082 | A | 4/1976 | Leggett |
| 4,037,580 | A | 7/1977 | Angelo |
| D258,259 | S | 2/1981 | Lindholm |

(Continued)

FOREIGN PATENT DOCUMENTS

| | | | |
|---|---|---|---|
| CN | 2035756 | U | 4/1989 |
| CN | 201715561 | U | 1/2011 |

(Continued)

OTHER PUBLICATIONS

International Search Authority, International Search Report and Written Opinion, ISA/KR, PCT/US2019/063180, dated Mar. 26, 2020, 10 pages.

(Continued)

*Primary Examiner* — Alfred Basichas
(74) *Attorney, Agent, or Firm* — Haynes and Boone, LLP

(57) ABSTRACT

A fire pit barrier may help reduce the likelihood of contact with a side of a fire pit. The fire pit barrier may include a frame couplable to the fire pit. The frame may include a top support, a bottom support, and at least one connector extending between the top support and the bottom support. The frame may also include a shield coupled to the frame. The fire pit barrier may be configured to cover an outer surface of the fire pit and inhibit heat transfer from the fire pit to an exterior side of the shield.

25 Claims, 10 Drawing Sheets

(56) References Cited

U.S. PATENT DOCUMENTS

| | | | | |
|---|---|---|---|---|
| D258,712 | S | 3/1981 | Jacobson | |
| D273,264 | S | 4/1984 | Elliston | |
| 4,454,828 | A | 6/1984 | Zempel | |
| 4,735,135 | A | 4/1988 | Walker | |
| 4,903,683 | A | 2/1990 | Larsen | |
| 5,024,208 | A | 6/1991 | Hottenroth | |
| 5,094,223 | A * | 3/1992 | Gonzalez | F24B 15/005 126/41 R |
| 5,117,558 | A | 6/1992 | Hull | |
| D355,809 | S | 2/1995 | Kothrade | |
| D358,204 | S | 5/1995 | Ferrier | |
| 5,490,452 | A | 2/1996 | Schlosser | |
| D379,900 | S | 6/1997 | Gillam | |
| 5,638,808 | A | 6/1997 | Home | |
| 5,651,356 | A | 7/1997 | Kaines | |
| 5,797,386 | A | 8/1998 | Orr | |
| 5,809,988 | A | 9/1998 | Wagner | |
| 6,024,081 | A | 2/2000 | Libertini, Jr. | |
| D422,452 | S | 4/2000 | Persson | |
| D435,191 | S | 12/2000 | Cooper | |
| 6,196,121 | B1 | 3/2001 | Crowl | |
| 6,196,215 | B1 | 3/2001 | Chandaria | |
| D442,422 | S | 5/2001 | Dabney | |
| D444,991 | S | 7/2001 | Measom | |
| 6,314,955 | B1 | 11/2001 | Boetcker | |
| 6,393,717 | B1 | 5/2002 | Santos | |
| 6,488,023 | B2 | 12/2002 | Pecoskie | |
| D488,023 | S | 4/2004 | Siegel | |
| D491,409 | S | 6/2004 | Siegel | |
| D495,552 | S | 9/2004 | Siegel | |
| D531,849 | S | 11/2006 | Turner | |
| D534,756 | S | 1/2007 | Jensen | |
| D549,300 | S | 8/2007 | Harrell | |
| D607,265 | S | 1/2010 | Gaunaurd, III | |
| D612,191 | S | 3/2010 | Taber | |
| D612,662 | S | 3/2010 | Lorenz | |
| D618,038 | S | 6/2010 | Davies | |
| 7,810,484 | B2 | 10/2010 | Schlosser | |
| D644,474 | S | 9/2011 | Wilgus | |
| 8,087,410 | B2 | 1/2012 | Gregory | |
| D658,426 | S | 5/2012 | Saunders | |
| D683,999 | S | 6/2013 | Karlsson | |
| D701,721 | S | 4/2014 | Jan | |
| 8,991,382 | B1 | 3/2015 | Mau | |
| D749,960 | S | 2/2016 | Bhattacharyya | |
| 9,844,300 | B2 | 12/2017 | Cedar | |
| 10,098,502 | B2 | 10/2018 | Ohler | |
| 10,125,995 | B2 | 11/2018 | Kohli | |
| 10,222,092 | B1 | 3/2019 | Traeger | |
| D858,729 | S | 9/2019 | Scott | |
| D914,858 | S | 3/2021 | Jan | |
| D923,163 | S | 6/2021 | Jan | |
| 11,092,342 | B2 | 8/2021 | Harrington | |
| 11,293,642 | B2 | 4/2022 | Jan | |
| 11,391,465 | B1 | 7/2022 | Weilert | |
| 11,692,713 | B2 | 7/2023 | Jan | |
| 11,703,227 | B2 | 7/2023 | Jan | |
| 11,879,641 | B2 | 1/2024 | Weilert | |
| 11,953,207 | B1 | 4/2024 | Weilert | |
| 12,060,998 | B1 * | 8/2024 | Ressler | F24B 15/007 |
| 2006/0219233 | A1 | 10/2006 | Sorenson | |
| 2007/0137634 | A1 | 6/2007 | Traeger | |
| 2009/0165772 | A1 | 7/2009 | Hunt | |
| 2010/0043775 | A1 | 2/2010 | Phillips | |
| 2011/0180527 | A1 | 7/2011 | Abbott | |
| 2012/0017884 | A1 | 1/2012 | Van Den Hoff | |
| 2013/0206131 | A1 * | 8/2013 | Hood | F24B 1/192 126/25 R |
| 2014/0007778 | A1 | 1/2014 | Marks | |
| 2014/0026765 | A1 | 1/2014 | Fou | |
| 2014/0165993 | A1 | 6/2014 | Ahmed | |
| 2014/0238378 | A1 | 8/2014 | Scott | |
| 2015/0068512 | A1 | 3/2015 | Mehler | |
| 2015/0110939 | A1 | 4/2015 | Benson | |
| 2015/0211743 | A1 | 7/2015 | Defoort | |
| 2017/0363325 | A1 | 12/2017 | Diurlin | |
| 2019/0313851 | A1 | 10/2019 | Shemp | |
| 2020/0096199 | A1 * | 3/2020 | Harrington | F24B 5/025 |
| 2020/0309369 | A1 | 10/2020 | Jan | |
| 2021/0018180 | A1 | 1/2021 | Jan | |
| 2021/0048188 | A1 * | 2/2021 | Harrington | F24B 5/026 |
| 2021/0199301 | A1 | 7/2021 | Poggi | |
| 2021/0274970 | A1 | 9/2021 | Stoltzfus | |
| 2021/0282592 | A1 | 9/2021 | Jan | |
| 2022/0252274 | A1 * | 8/2022 | Zemel | F24B 1/192 |
| 2022/0341596 | A1 * | 10/2022 | Muir | F24B 13/002 |
| 2023/0304667 | A1 | 9/2023 | Jan | |
| 2024/0011639 | A1 * | 1/2024 | Weilert | F24B 1/195 |

FOREIGN PATENT DOCUMENTS

| | | | |
|---|---|---|---|
| CN | 103528100 | A | 1/2014 |
| CN | 204388128 | U | 6/2015 |
| JP | H10323289 | A | 12/1998 |
| JP | 2000342462 | A | 12/2000 |
| JP | 2003190011 | A | 7/2003 |
| KR | 200295935 | Y1 | 11/2002 |
| KR | 100898493 | B1 | 5/2009 |
| KR | 20200122766 | A | 10/2020 |
| WO | 2017078762 | A1 | 5/2017 |

OTHER PUBLICATIONS

International Search Authority, International Search Report and Written Opinion, PCT/US2021/020687, dated Aug. 5, 2021, 11 pages.

Korean Intellectual Property Office, International Search Report and Written Opinion, PCT/US2022/011365, dated May 3, 2022, 12 pages.

Screen captures from YouTube video clip entitled "Solo Stove Bonfire: Best Gear of 2017," 4 pages, uploaded on May 14, 2017 by user "Canadian Prepper". Retrieved from Internet: https://www.youtube.com/watch?v=Vo_J_flWq5g.

Camping stove, https://www.kickstarter.com/projects/340672218/solo-stove-campfire-backpack-camp-survive/description, 21 pages (2014).

Solo Stove, webpage capture: https://www.solostove.com/solo-stove-bonfire, 2017, 8 pages.

* cited by examiner

FIRE PIT BARRIER

RELATED APPLICATIONS

This application is related to U.S. Design patent application No. 29/949,816, filed Jun. 28, 2024, entitled FIRE PIT BARRIER, the entire disclosure of which is hereby incorporated by reference herein.

FIELD

The present disclosure relates to fire pits, and more particularly to fire pit barrier systems and methods.

BACKGROUND

Fire pits are commonly used in yards, campsites, meeting places, and other locations to provide warmth and ambiance due to their sights, sounds, and smells. While providing the above benefits, fire pits present certain challenges. For example, surfaces of fire pits can become uncomfortably hot to a person, object, or animal which may come into contact with or enter into the close proximity of the fire pit. Portable fire pits can be placed anywhere, and are sometimes placed in areas of high traffic, where persons, objects, and animals move about. Because portable fire pits are not necessarily built into surrounding structure, exterior surfaces of the fire pit are exposed, increasing the risk of contact with hot surfaces. Even if the fire pit is not contacted, the radiant heat from the fire pit can cause damage. An essential component of fire is oxygen. Without oxygen, fires cannot be maintained. As such, fire pits must allow for air intake. Barriers or obstructions placed on the ground surrounding the fire pit inhibit air intake.

Therefore, there is a need for fire pit barrier systems and methods that may reduce the chance of direct contact with fire pit surfaces without inhibiting functionality.

SUMMARY

The examples of the invention are summarized by the claims that follow the description.

Consistent with some examples, a fire pit barrier may comprise a frame couplable to a fire pit, the frame comprising: a top support, a bottom support spaced apart from the top support, and at least one connector extending between the top support and the bottom support, and a shield coupled to the frame, the shield being configured to cover an outer surface of the fire pit and reduce the likelihood of contact with the outer side of the fire pit.

In some examples, the fire pit barrier may further comprise at least one bracket extending radially inwardly from the frame, the at least one bracket being configured to hang the fire pit barrier from an edge of the fire pit. The fire pit barrier may further comprise at least one spacer extending inwardly to maintain space between the fire pit and the shield. A width of the at least one spacer may be less than a width of the at least one bracket such that the at least one spacer is not in contact with the fire pit when the fire pit barrier hangs from the fire pit in equilibrium.

In some examples, the fire pit barrier may be configured to allow air to flow past a bottom portion of the shield for intake into a lower portion of the fire pit. The shield may have an interior side and an exterior side spaced from the interior side in a manner forming a insulative gap. The at least one connector may define a plurality of holes that helps dissipate heat from the frame to an environment. The fire pit barrier may further comprise a grille positioned atop the frame, the grille may define a plurality of holes to dissipate heat from the frame to an environment, and the grille may be configured to protect the at least a portion of the shield from radiant heat, infrared heat, direct heat, or any combination thereof.

In some examples, the top support may include a plurality of top support members extending laterally between top portions of the at least one connector, and the bottom support may include a plurality of bottom support members extending laterally between bottom portions of the at least one connector. The shield may include a plurality of sections, each of the plurality of sections may be coupled to one of the top support members and one of the bottom support members, and the shield may be flexible and heat resistant.

Consistent with some examples, a fire pit system may comprise a fire pit having an upper portion, a lower portion, and an external surface forming a fire pit perimeter, and a fire pit barrier sized to extend about a permitter of the fire pit, the fire pit barrier comprising: a frame comprising a bracket extending from the fire pit barrier and couplable to the upper portion of the fire pit in manner causing the fire pit barrier to hang from the fire pit, and a shield supported by the frame and disposed to be spaced apart from the external surface, the fire pit barrier configured to allow air to flow past a bottom portion of the shield for intake into the lower portion of the fire pit.

In some examples, the fire pit barrier may be further configured to cover an outer surface of the fire pit and inhibit heat transfer from the fire pit to an exterior side of the shield. The fire pit barrier may further comprise at least one bracket including a hook configured to hang the fire pit barrier from an edge of the upper portion of the fire pit. The shield may be spaced from the fire pit to maximize heat transfer from the fire pit to an environment and to minimize heat transfer from the fire pit to the shield.

In some examples, the shield may have an interior side spaced from an exterior side to minimize heat transfer from the interior side to the exterior side. The frame may define a plurality of holes to maximize heat transfer from the frame to an environment.

Consistent with some examples, a method may comprise: assembling a fire pit barrier by attaching a shield to a frame, the frame comprising: a top support, a bottom support, and connectors extending between the top support and the bottom support, and hanging the fire pit barrier from an edge of a fire pit using at least one bracket extending between the frame and the fire pit, the fire pit barrier configured to inhibit heat transfer from the fire pit to an exterior side of the shield.

In some examples, the method may further comprise intaking air into the fire pit to maintain a fire, the air flowing beneath the shield. The method may further comprise removing the fire pit barrier from the fire pit after the fire extinguishes. The at least one bracket may be positioned near the top support and extends inwardly from the frame, and at least one spacer may be positioned near the bottom support and extends inwardly from the frame.

Consistent with some examples, a fire pit barrier may comprise a frame having at least one connector extending configured to engage a fire pit in manner that suspends the frame from the fire pit, and a shield coupled to the frame, the shield configured to be spaced apart from and cover an outer surface of the fire pit in a manner inhibiting contact with the outer surface of the fire pit.

In some examples, the fire pit barrier may further comprise at least one bracket extending radially inwardly from the frame, the at least one bracket being configured to hang the fire pit barrier from an edge of the fire pit. The fire pit barrier may further comprise at least one spacer extending inwardly from the frame or shield to maintain space between the fire pit and the shield.

In some examples, the frame may comprise a top support and a bottom support, the top support and the bottom support may be spaced apart, and the shield may be a fabric extending between the top support and the bottom support to cover the outer surface of the fire pit. The fabric may be a sleeve extending about both the top support and the bottom support.

BRIEF DESCRIPTION OF THE DRAWINGS

The accompanying drawings illustrate examples of systems, devices, and methods disclosed herein and together with the description, serve to explain the principles of the present disclosure.

Figure 1:
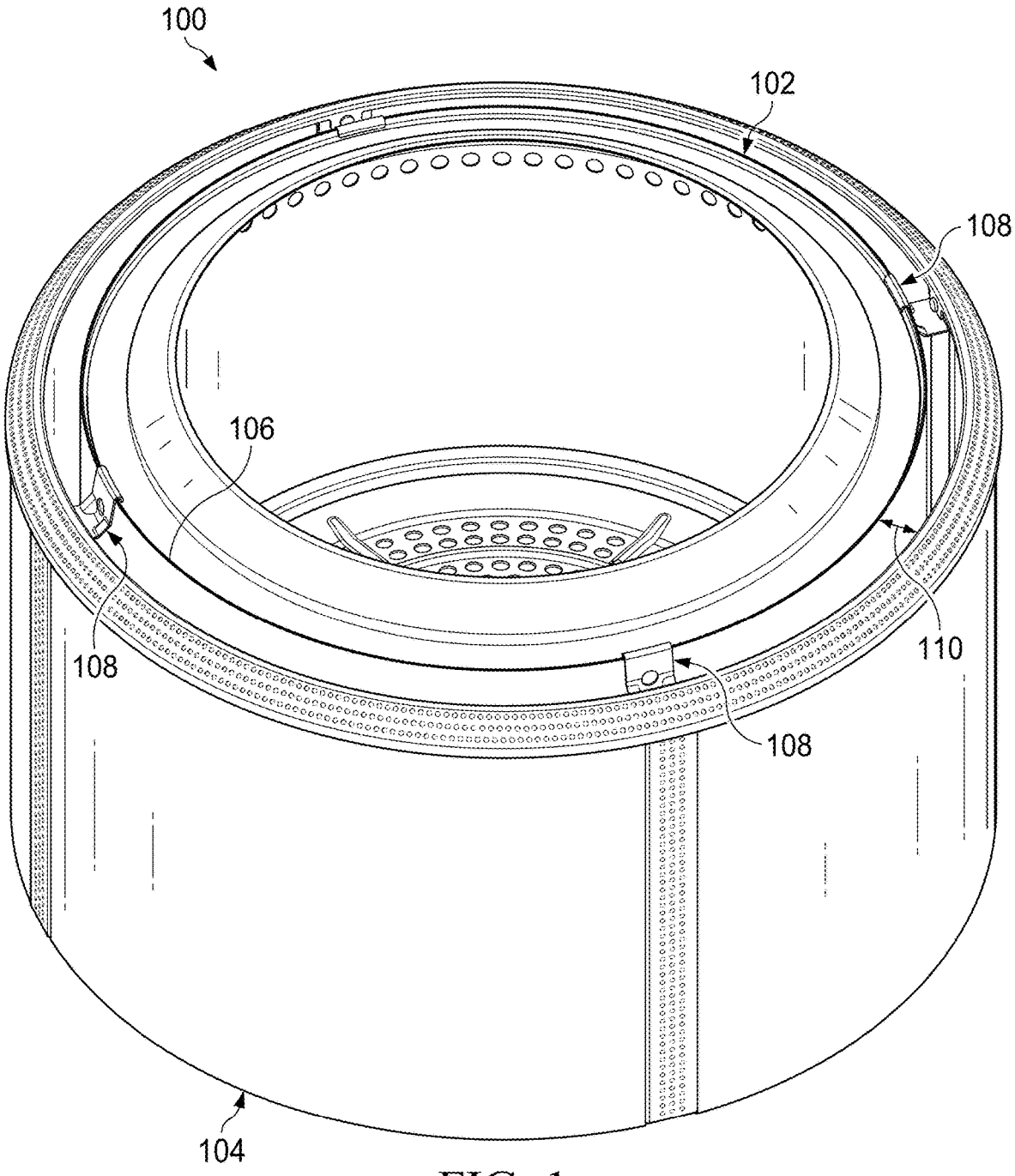
FIG. 1 is a perspective view of a fire pit system, according to examples of the present disclosure.

These Figures may be better understood by reference to the following Detailed Description.

DETAILED DESCRIPTION

For the purpose of promoting an understanding of the principles of the present disclosure, reference will now be made to the examples illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other examples or Figures of the present disclosure. For simplicity, in some instances the same or similar reference numbers are used throughout the drawings to refer to the same or like parts.

The present disclosure contemplates a heat barrier for a fire pit and associated methods. The heat barrier may be disposed about outer surfaces of the fire pit and may reduce the likelihood of direct contact with the outer surfaces of the fire pit. The examples herein may provide advantages including, but not limited to: reducing the likelihood of contact between people, objects and animals and the fire pit, minimizing heat transfer from a fire pit to an exterior side of a fire pit barrier, minimizing heat transfer from an interior side of a fire pit barrier to an exterior side of the fire pit barrier, maintaining space between a fire pit barrier and a fire pit, maximizing heat transfer from a fire pit barrier to an environment, and providing a fire pit barrier that allows for air to be taken into a fire pit. All of these advantages as well as further advantages discussed herein enhance the comfort of fire pits without inhibiting functionality, among other things.

FIG. 1 shows a fire pit system 100 including a fire pit 102 and a fire pit barrier 104. In some examples, the fire pit 102 is a propane fire pit, a wood burning fire pit, a natural gas fire pit, or a gel fuel fire pit, among other types of fire pits. The fire pit 102 can be a portable fire pit as shown or can be a stationary fire pit. In some examples, the fire pit 102 is a smokeless fire pit in which two burns occur. A first burn of the fuel may occur towards a lower portion 800 (shown in FIG. 8) of the fire pit 102 and a second burn may occur towards an upper portion 802 (shown in FIG. 8), the second burn reducing the ashes, smoke, or residue produced by the first burn. In some examples, the fire pit 102 intakes air in the lower portion 800 through holes defined in the fire pit 102. The air may be sucked in from the surrounding environment. Accordingly, one advantage of the disclosure herein is to provide the fire pit 102 with a heat-resistant barrier that does not inhibit air intake. This aspect will be discussed further with respect to FIG. 8.

Figure 2:
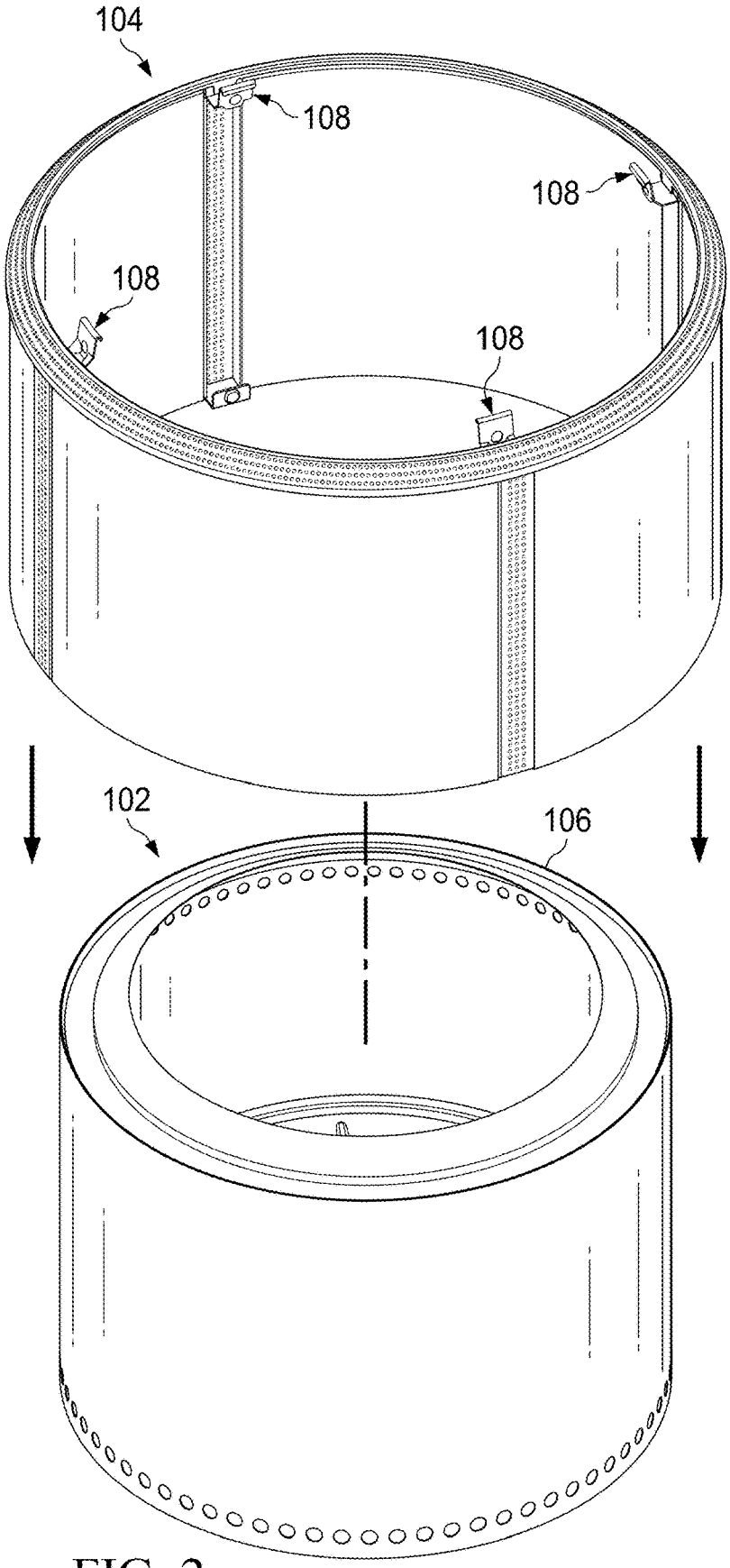
FIG. 2 is a perspective view of a fire pit system showing a fire pit and a fire pit barrier, according to examples of the present disclosure.

FIG. 1 shows the fire pit barrier 104 disposed about the fire pit 102 in a user configuration. FIG. 2 shows the fire pit barrier 104 ready to be introduced over or otherwise coupled to the fire pit 102. When the fire pit barrier 104 is positioned over the fire pit 102 the fire pit barrier 104 can be slid over the fire pit 102 or otherwise placed around the fire pit in a manner that covers the sides of the fire pit to place the first pit system in the use configuration. The fire pit barrier 104 may be assembled prior to being introduced over the fire pit 102.

These Figures show the fire pit barrier 104 coupled to and suspended or hanging from an edge 106 or other surface or feature of the fire pit 102 by a plurality of brackets 108. Although shown with four evenly spaced brackets 108, some examples have more than four or fewer than four individual brackets 108. Some examples have only one bracket 108 usable to hang the fire pit barrier 104 from the fire pit 102. Hanging the fire pit barrier 104 from the fire pit 102 is not the only way in which the fire pit barrier 104 can be coupled to the fire pit 102. The fire pit barrier 104 can be coupled in any other way. For example, the fire pit barrier 104 may be fastened, adhered, latched, or pressure fit to the fire pit 102. This is a non-limiting list and all other conventional methods for attaching two items together are contemplated.

In some examples, the fire pit barrier 104 may surround the fire pit 102 on all permitter sides, to reduce the likelihood of contact with the fire pit 102, including the covered side of the fire pit. In some examples, the fire pit system 100 is configured to minimize heat transfer from the fire pit to an exterior side of the fire pit barrier 104. As shown, the fire pit barrier 104 may be coupled to the fire pit 102 in a manner such that the fire pit barrier 104 is spaced from the fire pit 102. The space, illustrated by arrows 110 between the fire pit 102 and the fire pit barrier 104 acts as insulation or an insulative air gap, helping regulate (e.g., reduce the likelihood of) the fire pit barrier 104 from getting overly hot. The space or gap between the fire pit wall and the fire pit barrier 104 permits heat which radiates from the fire pit 102 to escape downwards or upwards to the environment, rather than being transferred to the fire pit barrier 104. These and other aspects of the disclosure enhance the comfort, usability, and functionality of the fire pit.

Figure 3:
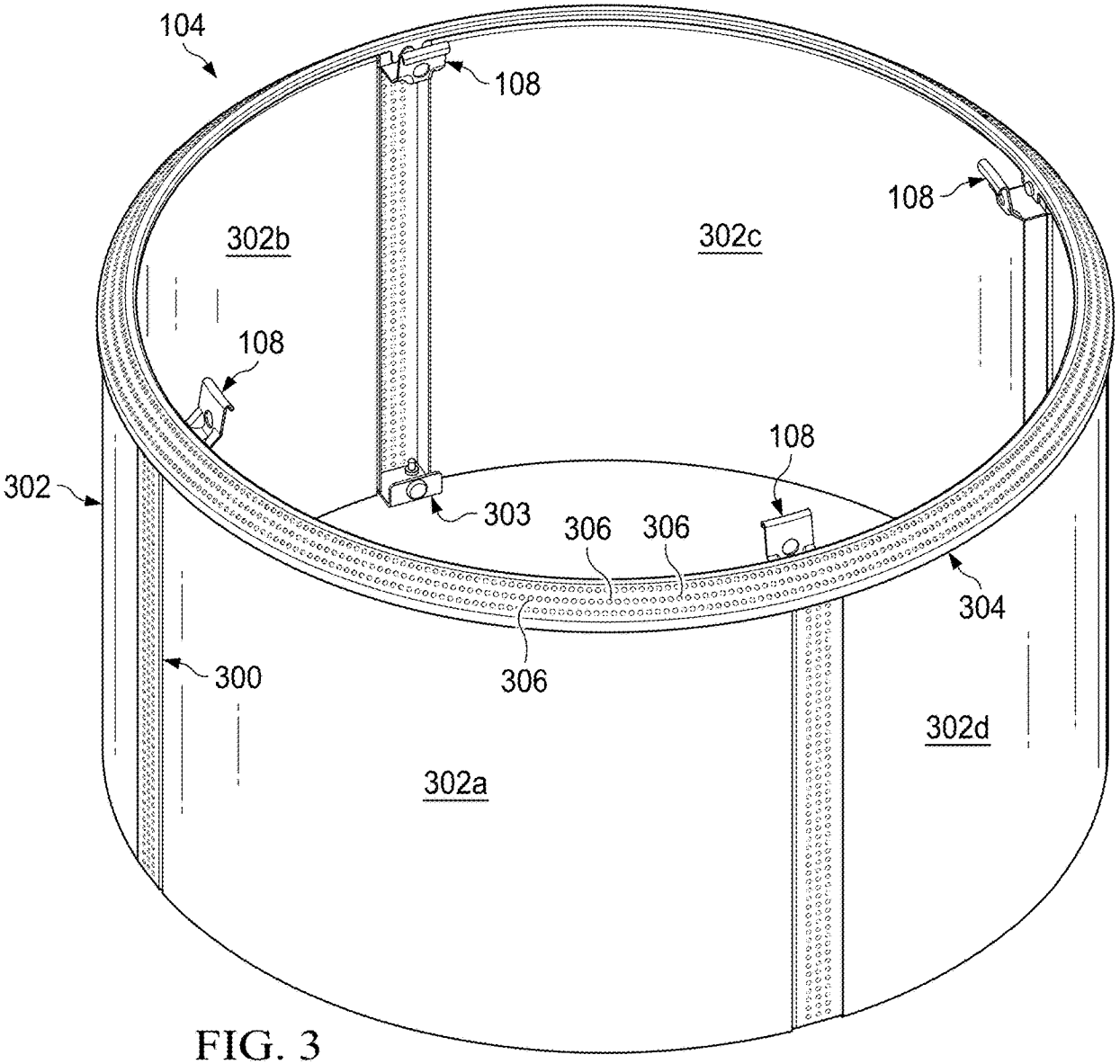
FIG. 3 is a perspective view of a fire pit barrier, according to examples of the present disclosure.

FIG. 3 shows the fire pit barrier 104, alone. In some examples, the fire pit barrier 104 may include a frame 300 and a shield 302. The frame 300 may provide structural support for the shield 302, maintaining the relationship between the fire pit 102 and the fire pit barrier 104, when coupled. Further details about the frame 300 will be discussed below with respect to FIG. 4.

The shield 302 is carried by the frame 300 and protects the fire pit 102 and reduces the chance of people, objects, and animals from coming into contact with a hot surface of the fire pit 102. The shield 302 also helps reduce the chance of other items from getting too close to the fire pit 102. In some examples, as shown, the shield 302 may include a plurality of sections 302*a*, 302*b*, 302*c*, 302*d*. Each of the plurality of sections 302*a*, 302*b*, 302*c*, 302*d* may be coupled to a section of the frame 300. For example, the plurality of sections 302*a*, 302*b*, 302*c*, 302*d* of the shield 302 may couple with the sections 400*a*, 400*b*, 400*c*, 400*d* of a top support 400 of the frame 300 and/or couple with sections 402*a*, 402*b*, 402*c*, and 402*d* of a bottom support 402 of the frame 300. (shown in FIG. 4). The shield 302 may have any number of sections. Each section of the shield 302 may be in the shape of a sleeve having two openings through which the top support 400 and the bottom support 402 can extend through.

The shield 302 may be made of any material, including heat-resistant materials. In some examples, the shield 302 is flexible or semi-flexible, which decreases the weight and size of the fire pit barrier 104. When the shield 302 is a flexible material the fire pit barrier 104 can be shipped in smaller packages, decreasing costs of production and shipping. If the shield 302 is a flexible material, the frame 300 may hold the shield 302 taught or tight. When the frame 300 causes the shield 302 to remain taught, the shield 302 may be more resistant to external forces. In some examples, the shield 302 may be a fabric, cloth, or any other thin material.

The brackets 108 of the fire pit barrier 104 may be part of or separable from the frame 300. The brackets 108 may include a hook, clasp, interface surface, or other mechanism that attaches the fire pit barrier 104 to the fire pit 102. The hook is configured to hang the fire pit barrier 104 from the edge 106 of the fire pit 102. The brackets 108 will be discussed further below with respect to FIG. 6. In this implementation, the brackets 108 are disposed to extend from an upper portion of the barrier radially inwardly toward the fire pit. They may be secured to the top support 400, a connector 404, or otherwise secured thereto. The fire pit barrier 104 may also include one or more spacers 303. The spacers 303 extend inwardly towards the fire pit 102 to maintain space between the fire pit 102 and the shield 302. The spacers 303 may be part of or separable from the frame 300. The spacers 303 will be discussed further below with respect to FIG. 7.

The fire pit barrier 104 may also include a grille 304. The grille 304 may be part of or separable from the frame 300. In some examples, the grille 304 is positioned atop the frame 300, enclosing the top part of the frame 300. The grille 304 may function as a cap, covering and enclosing portions of the fire pit barrier 104 including the top support 400, the connectors 404, the brackets 108, and the shield 302. The grille 304 may be aesthetically pleasing and may provide further strength to the fire pit barrier 104. In some examples, the grille 304 defines a plurality of holes 306 to maximize heat transfer from the fire pit barrier 104 to the environment. It is advantageous that the grille 304 dissipates heat to the environment so that the grille 304 maintains a reasonable temperature. Furthermore, the holes in the grille 304 make the grille lighter and reduce material costs.

The grille 304 may also protect the shield 302 from damage caused by radiant heat, infrared heat, and direct heat contact, and minimizes the temperature of the shield 302. As heat is push upwards and/or outwards from the fire pit 102, some heat may flow towards the shield 302. For example, heat may pass over and downwards around the edge 106 of the fire pit 102 and towards the shield 302. Because the grille 304 is positioned atop the frame 300 and around portions of the shield 302, the grille 304 re-directs the heat away from all or portions the shield 302. In some examples, where the fire pit 102 is used in windy conditions, flames may curve around the edge 106 towards the shield 302. Similar to the prevention of radiant and infrared heat, the grille 304 is configured obstruct contact between the flames and the shield 302 (e.g., the upper edge). The shape and size of the grille 304 allows the grille 304 to cover and protect a plurality of sides (e.g., exterior, interior, top) of the shield 302 simultaneously. In this way, the shield 302 remains structurally sound and does not get overly hot.

Figure 4:
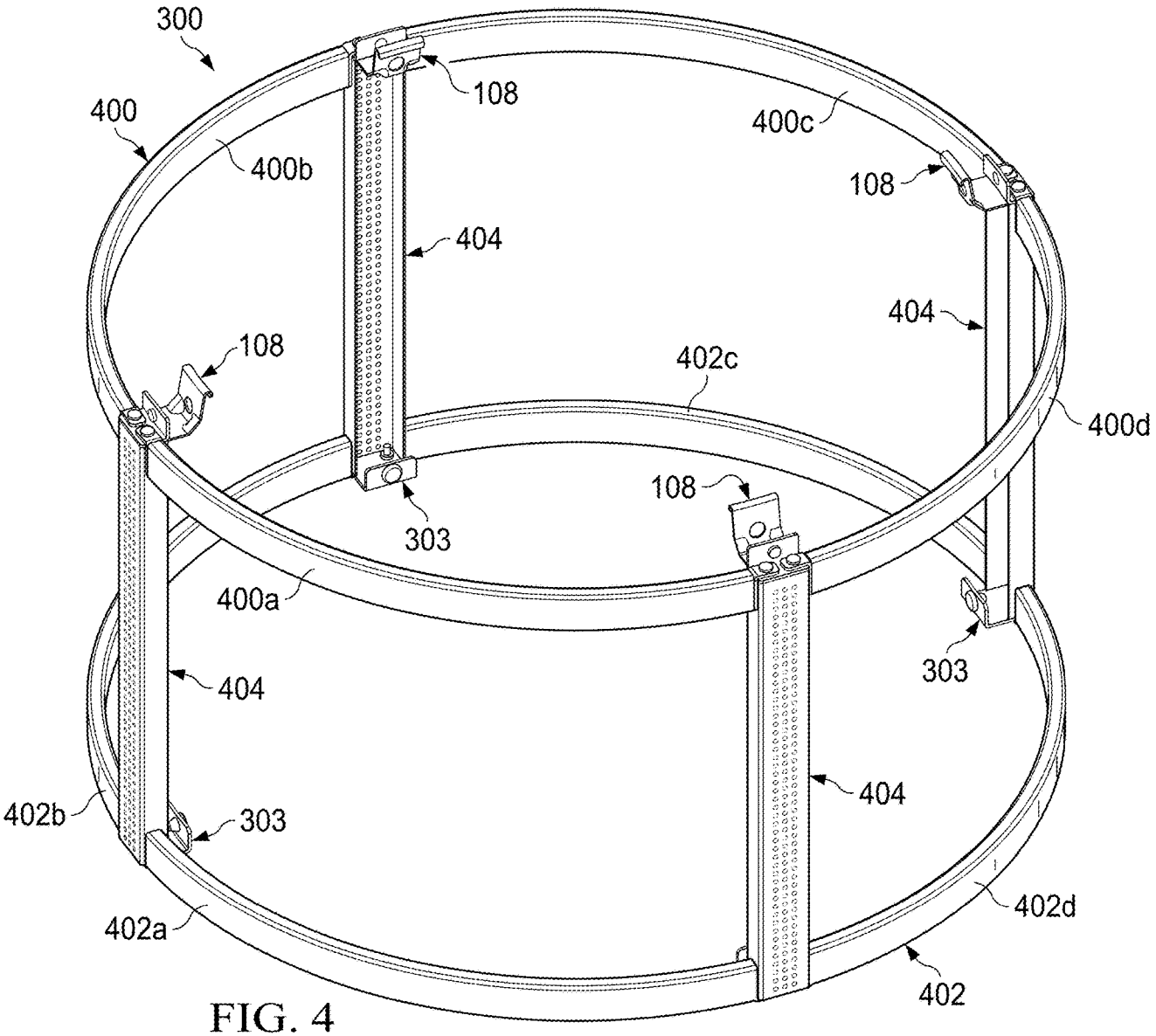
FIG. 4 is a perspective view of a frame of a fire pit barrier according to examples of the present disclosure.

FIG. 4 shows the frame 300 independent of the shield 302. The frame 300 may be made of metal or any rigid or semi-rigid material. For example, the frame 300 may be made of a heat-resistant plastic or a heat-resistant metal, among other things. The frame 300 may include the top support 400, the bottom support 402, and the connectors 404 that may extend between the top support 400 and the bottom support 402. The connector 404 may connect the top support 400 and the bottom support 402 directly or indirectly. In the implementation shown, the top support 400 and the bottom support 402 are horizontal bars and the connector 404 is a more vertical bar.

Figure 5:
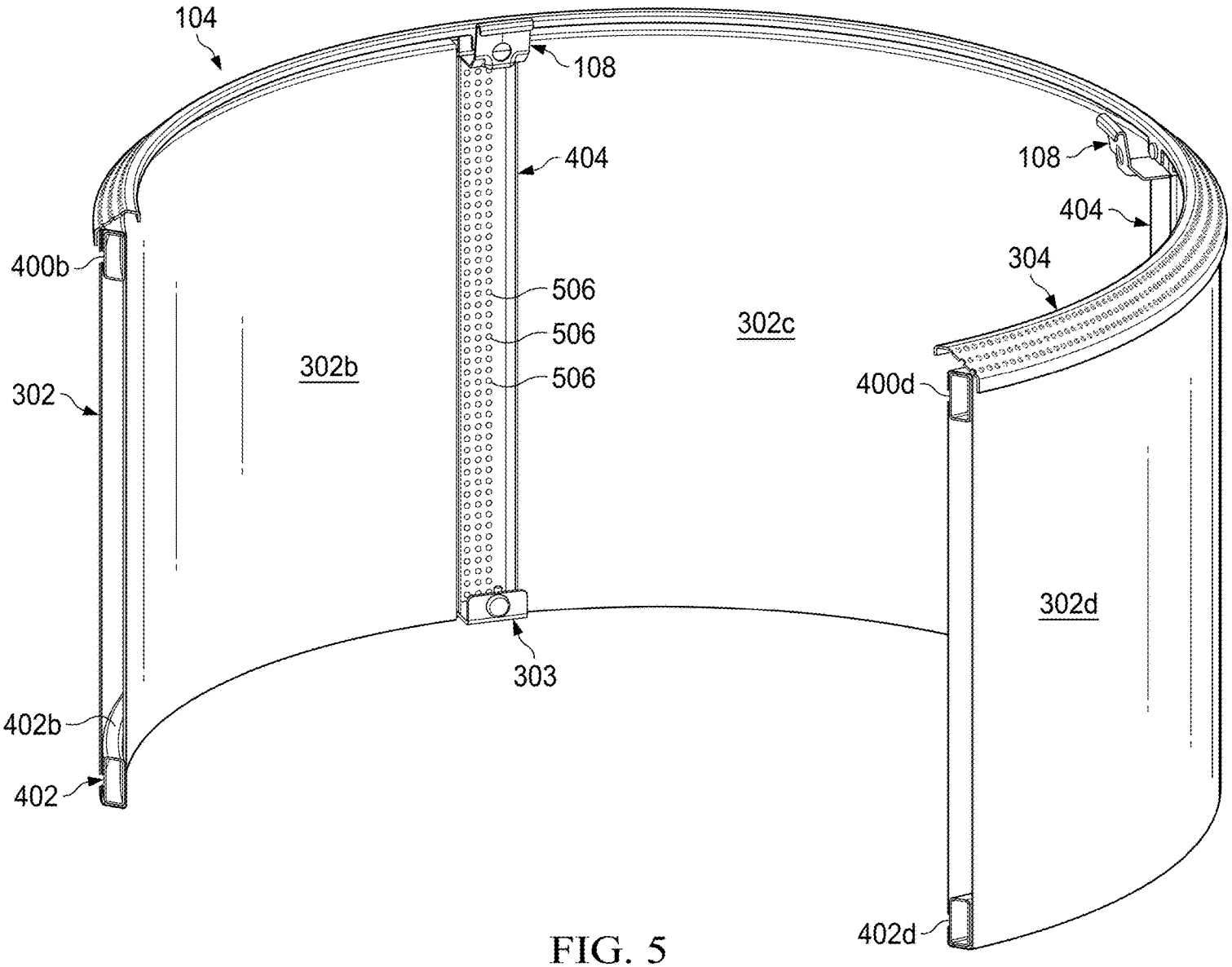
FIG. 5 is a perspective section view of a fire pit barrier, according to examples of the present disclosure.

As shown in this example in FIGS. 4 and 5, the top support 400 and the bottom support 402 form circumferences at upper and lower portions of the fire pit barrier 104. The top support 400 may be formed of a plurality of top support members 400*a*, 400*b*, 400*c*, 400*d* each extending laterally between top portions of the connectors 404. The bottom support 402 may be formed of a plurality of bottom support members 402*a*, 402*b*, 402*c*, 402*d* each extending laterally between bottom portions of the connectors 404. The top support 400 may provide structural rigidity to a top portion of the frame 300 and the bottom support 402 may provide structural rigidity to a bottom portion of the frame 300.

In some examples, as shown in FIG. 5, the top support 400 and the bottom support 402 may be one or more hollow and curved tubes. When coupled, the top support members 400*a*, 400*b*, 400*c*, 400*d* and bottom support members 402*a*, 402*b*, 402*c*, 402*d* form circumferences of the fire pit barrier 104. In some examples the circumference may be circular, ovular, square, rectangular, triangular, or any other shape. The top support 400 and the bottom support 402 may be coupled or fastened to the connectors 404 and/or the brackets 108 and the spacers 303.

FIG. 5 shows a perspective section view of the fire pit barrier 104. The section view allows for visualization of inner portions of the fire pit barrier 104 not otherwise seen from the outside. For example, the top support 400 and the bottom support 402 are shown disposed within the shield 302. To that end, in this example, the shield is a flexible sleeve that may be slid or otherwise introduced over the top support 400 and the bottom support 402. The shield 302 may be a stretchable material having elastic properties that enable to stretch to encompass both the top support 400 and the bottom support 402, while remaining taut for a clean, smooth appearance.

In some examples, the one or more connectors 404 define a plurality of holes 506 to maximize heat from the fire pit barrier 104 to the environment. The holes 506 may be positioned in portions or all of the connectors 404. The holes 506 may assist with temperature control of the connectors 404 by allowing the connectors 404 and other portions of the frame 300 to release heat into the environment. Holes similar to the holes 306 and 506 may be positioned in other portions of the fire pit barrier 104 or the fire pit 102 to assist with temperature control of the fire pit system 100. For example, in some examples, the shield 302 may include holes that help to dissipate heat.

Figure 6:
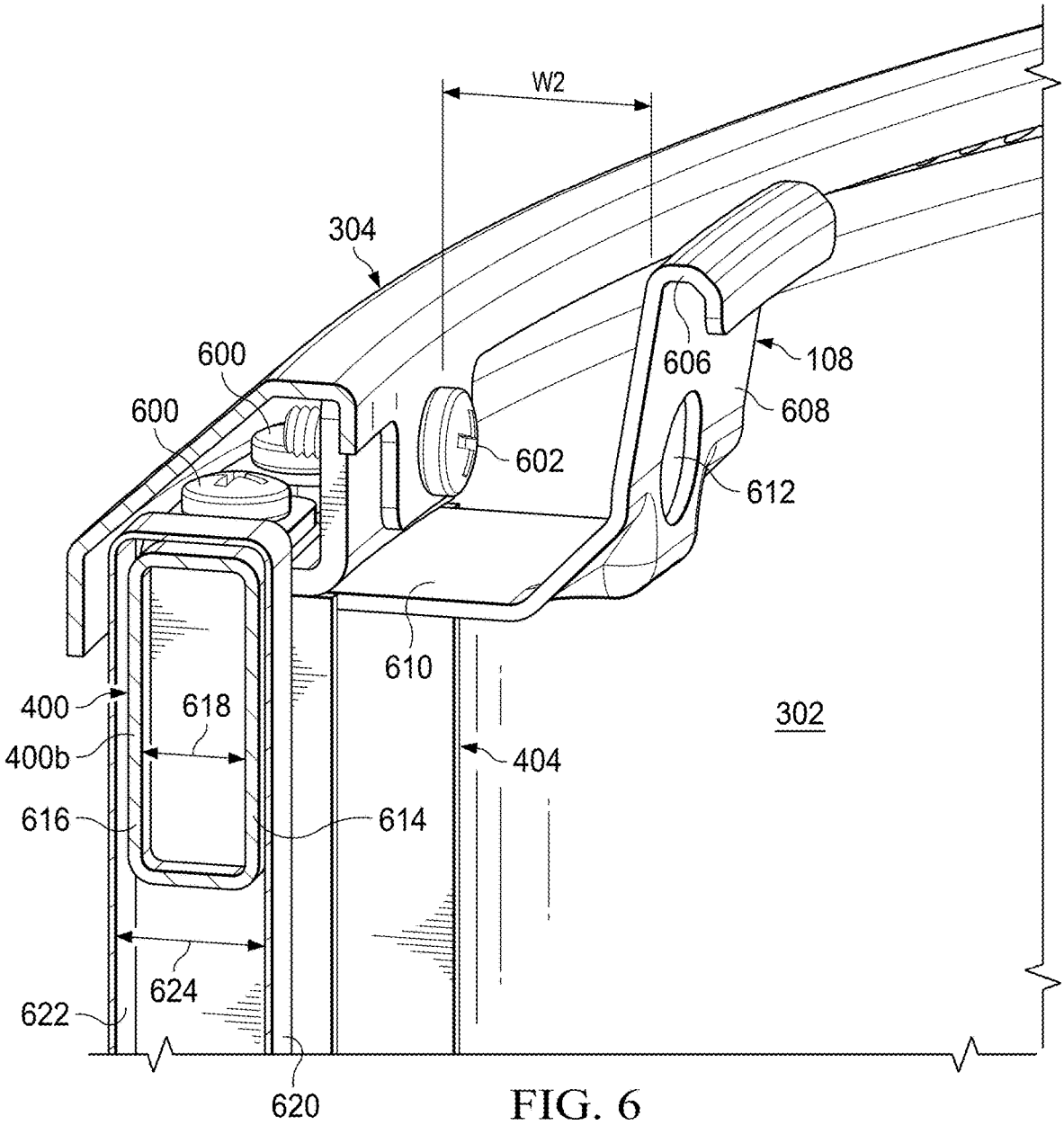
FIG. 6 is a perspective section view of a portion of a fire pit barrier, according to examples of the present disclosure.

FIG. 6 shows a section view at a connection point of a top portion of the fire pit barrier 104. At this example connection point, two of the top support members 400*a*, 400*b*, 400*c*, 400*d* of the top support 400 are fastened to the connector 404 by fasteners 600. The grille 304 is also fastened to the connector 404 by a fastener 602. The fasteners may be screws or bolts or other fasteners. The bracket 108 extends inwardly from this connection point.

In some examples, the bracket 108 includes a hook 606. The hook 606 may be configured to suspend or otherwise hang the fire pit barrier 104 from the edge 106 of the fire pit 102. In some examples, the hook 606 may hang from some other protruding feature of the fire pit 102. For example, the fire pit 102 may have a plurality of features that correspond to the plurality of brackets 108. Sometimes, multiple hooks 606 may be used at different and opposing connection points of the frame 300. The hook 606 need not be hung from the upper portion 802 of the fire pit 102 as shown. The hook 606 can connect to the bottom portion 800 of the fire pit 102 such that the bracket 108 holds the fire pit barrier 104 up from underneath. This may be desired to hide the brackets 108 from plain view.

The hook or other mechanism 606 used for coupling the fire pit barrier 104 to the fire pit 102 may be configured differently than shown. For example, the hook 606 may not include a curved portion. Rather, the curved portion of the hook 606 could be a flat surface which is laid on top of a portion of the fire pit 102. The mechanism 606 may of any shape or width. The hook 606 may be curved along a longitudinal axis of the hook to correspond to a curved edge or lip of the fire pit barrier 104. When more than one bracket 108 is used, the mechanism 606 could be any tab or extension extending inwardly that rests against the fire pit 102 to suspend the fire pit barrier 104 and keep it from falling downwards. Together, the mechanisms 606 could suspend the fire pit barrier 104 without including a hook.

Structurally, the bracket 108 may also include a resting portion 608 and a spacing portion 610. The spacing portion 610 may extend laterally away from the connector 404 and towards the fire pit 102 to space the fire pit barrier 104 from the fire pit 102. The spacing portion 610 may be of any dimension. The larger the dimension of the spacing portion 610, the larger the amount of insulating spacing there will be between the fire pit 102 and the fire pit barrier 104 when the fire pit system 100 is assembled. The resting portion 608 may be oriented substantially vertically or at an angle with respect to the spacing portion, even though it forms a part of the radially extending bracket 108. The resting portion 608 may have an inner surface and at least a portion of the inner surface may be configured to rest against a side of the fire pit 102 when the fire pit barrier 104 is coupled to the fire pit 102. The resting portion 608 may act to reduce the likelihood of the bottom portion of the fire pit barrier 104 from swinging inwardly towards the fire pit 102, thereby maintaining the space between the fire pit 102 and the fire pit barrier 104.

In some examples, the bracket 108 defines an access hole 612. The access hole 612 may facilitate assembly of the fire pit barrier 104. Particularly, one may fasten the grille 304 to the connector 404 by extending a tool through the access hole 612 to tighten the fastener 602. Accordingly, the access hole is aligned with the fastener 602. Some bracket implementations are nearly completely horizontal and extend radially inward to rigidly rest on the top of the fire pit. Other bracket implementations comprise a hook that hangs over the inner wall toward the combustion chamber. Other bracket implementations merely rest on a portion of the top of the fire pit. Yet others are also contemplated.

FIG. 6 also shows the top support member 400*b* of the top support 400. The top support member 400*b* and 400*c* (hidden by shield 202) are attached to the connector 404 by fasteners 600. Even though the fasteners 600 and are shown as connecting the top support members 400*b*, 400*c* to the connector 404, it is understood that any components described herein could be welded together. opposing end (not shown) of the top support members 400*b*, 400*c* are also connected to different connectors 404. In some examples, the top support 400 may be hollow. The cross section of the top support members (e.g., 400*b*) may be rectangular as shown, circular, or any other shape. The hollow nature of the top support 400 reduces the weight of the fire pit barrier 104, but also furthers the goal of reducing heat transfer. An inner side 614 is spaced from an outer side 616, as shown by arrows 618. Because the inner side 614 of the top support 400 is spaced from the outer side 616, the gas within the top support 400 will transfer heat at a slower rate than if the component was solid. Any component of the fire pit barrier 104, including the top support 400 and the bottom support 402, may be filled with a gas or all the gas may be sucked from the internal volume, thereby slowing heat transfer. Known methods for evacuating air from a component are contemplated. The spacing between the inner side 614 and the outer side 616 may also act to form a gap between opposing sides of the shield 302.

The shield 302 may have an interior side 620 spaced from an exterior side 622 as shown by arrows 624. The spacing between the two sides of the shield minimizes heat transfer from the interior side 620 to the exterior side 622. Even if the fire pit 102 were to warm the interior side 620, only limited heat would be passed to the exterior side 622 because the air or other gas between the two sides serves as an insulating gap. Furthermore, the shield 302 may be made of any material that does not absorb or conduct heat. In some examples, the shield 302 or sections of the shield 302 may be a single piece of material, such as a sleeve as mentioned previously. In some examples, the shield 302 or sections of the shield 302 may be formed of multiple pieces of material. In some examples, the shield 302 is formed of two pieces of material attached together to form a sleeve so that the interior side 620 is formed of a first material, and the exterior side 622 is formed of a second, different material. In some examples, one of the interior side 620 and the exterior side

622 is formed of an aramid fiber and the other of the interior side 620 and the exterior side 622 is formed of a pre-oxidized fiber. Other material make-ups are contemplated. Some implementations contemplate fabrics, such as those discussed herein are flame resistant and will provide good protection against inadvertent contact with the sides of the fire pit.

In some implementations, such as when the shield 302 is formed of a sleeve, the shield 302 may wrap around the top support member of the top support 400 while also being wrapped around the bottom support member of the bottom support 402. During assembly of the fire pit barrier 104, the bottom support member may be inserted into one opening in the shield 302 and passed out another opening, thereby coupling the shield 302 to the frame. Similarly, when the frame 300 includes the bottom support 402, one of the plurality of bottom support members may be inserted into one opening in the shield 302 and passed out another opening, thereby coupling the shield 302 to the bottom support 402 of the frame 300. Other shield implementations are only a single layer attached to and extending between the top frame and the bottom frame.

Although this disclosure only shows the frame having the top support 400 and the bottom support 402, the frame 300 can include other circumferentially-extending support members as well. For example, a middle support could be positioned between the top support 400 and the bottom support 402. The middle support may help to maintain the spacing between the interior side 620 and the exterior side 622 of the shield 302 in a middle portion of the fire pit barrier 104. However, the middle support may not be needed if the shield 302 is held tightly between the top support 400 and the bottom support 402.

In some examples the shield 302 or sections of the shield 302 are not formed by a single piece of material. For example, the interior side 620 may be separate from the exterior side. The interior side 620 may be coupled to the inner side 614 of the top support 400 while the exterior side 622 is coupled to the outer side 616 of the top support 400.

Figure 7:
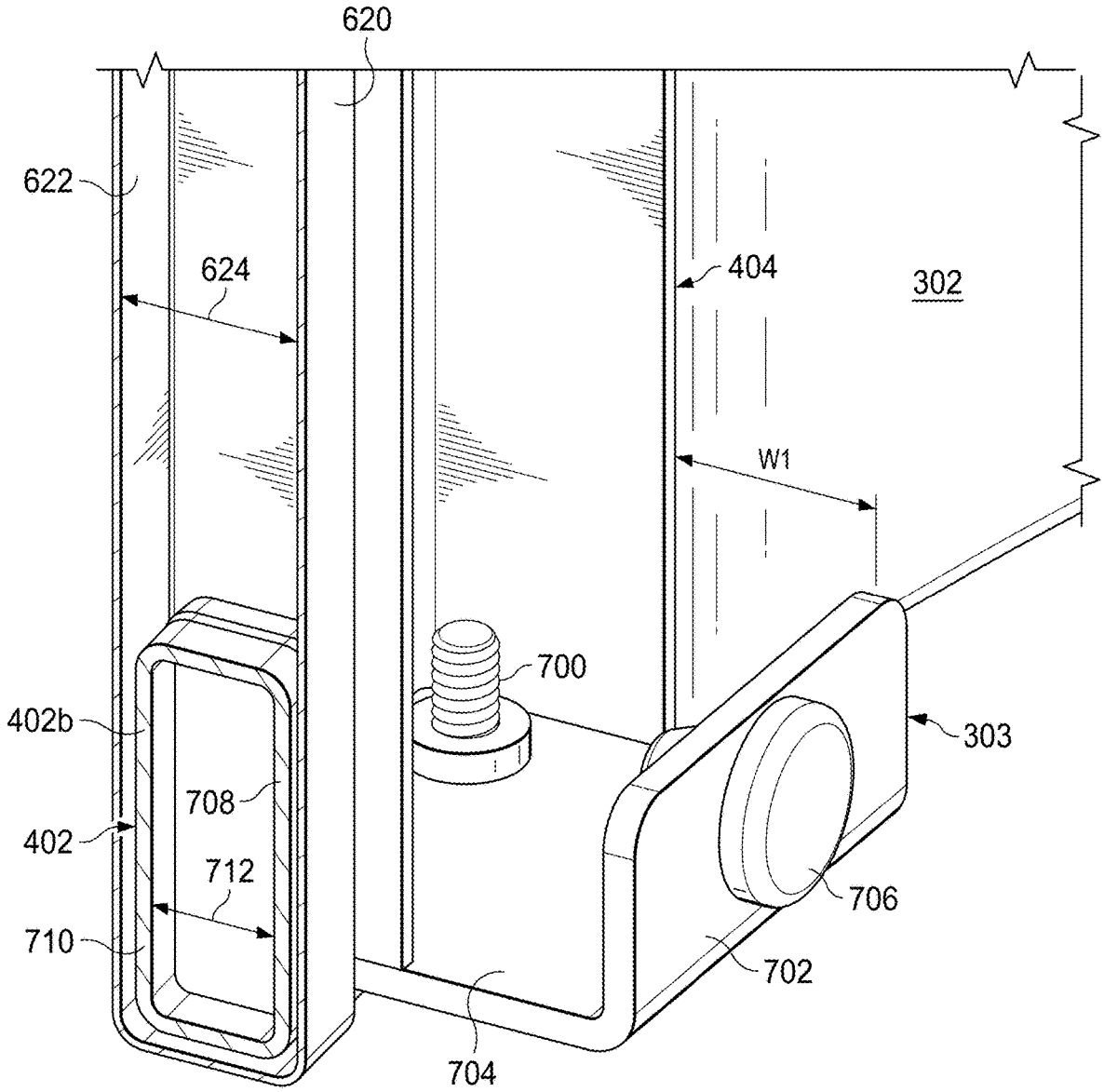
FIG. 7 is perspective section view of a portion of a fire pit barrier, according to examples of the present disclosure.

FIG. 7 shows a section view at a connection point of a bottom portion of the fire pit barrier 104. At this example connection point, at least one bottom support member (e.g., 402*a*) of the bottom support 402 is fastened to the connector 404 by a fastener 700. Also shown positioned near the bottom support 402 is the spacer 303, which is extending inwardly from the connector 404 of the frame 300. In some examples, the spacers 303 extend radially inwardly from the bottom support 402 or the connectors 404 near the bottom support 402. As is apparent from a review of the Figures herein, the spacers 303 project radially inwardly a distance smaller than the brackets 108 extend radially inwardly. Thus, the spacers 303 may be disposed adjacent to the outer surfaces of the fire pit, while the brackets 108 extend radially inward beyond the outer surface of the first pit to a location directly above a portion of the fire pit.

The spacer 303 may include a stopping portion 702 and a spacing portion 704. The spacing portion 704 may extend laterally away from the connector 404 and towards the fire pit 102 to space the fire pit barrier 104 from the fire pit 102. The spacing portion 704 may be of any dimension. The larger the dimension of the spacing portion 704, the larger the amount of insulating spacing there will be between the fire pit 102 and the fire pit barrier 104 when the fire pit system 100 is assembled.

The stopping portion 702 may be oriented substantially vertically with respect to the spacing portion 704. The stopping portion 702 may have an inner surface and at least a portion of the inner surface may be configured to stop the fire pit barrier 104 from contacting a side of the fire pit 102. The stopping portion 702 may help block the bottom portion of the fire pit barrier 104 from swinging inwardly towards the fire pit 102, thereby maintaining the space between the fire pit 102 and the fire pit barrier 104.

In some examples, a width W1 of the spacing portion 704 of the spacer 303 may be less than a width W2 (shown in FIG. 6) of the spacing portion 610 of the bracket 108. When the width W1 is less than the width W2, the spacer 303 does not contact the fire pit 102 when the fire pit barrier 104 hangs in equilibrium. The spacer 303 acts as a stopper, only contacting the fire pit 102 when the fire pit barrier 104 is pushed from the outside towards the fire pit 102. Because the spacer 303 is not in contact with the fire pit 102 at all times, heat cannot move directly from a surface of the fire pit 102 to the spacer 303.

In some examples, the width W1 of the spacing portion 704 of the spacer 303 can be the same as or larger than the width W2 of the spacing portion 610 of the bracket 108. When the widths W1 and W2 are the same or substantially the same, the spacer 303 may be in constant contact with the fire pit 102. In these examples, the distance between the fire pit 102 and the fire pit barrier 104 remains constant, as the fire pit barrier 104 is unable to rotate or pivot at the point where the hook 606 is in contact with the edge 106.

The stopping portion 702 may also include a stopper 706. The stopper 706 may be made of a polymeric material to minimize the sound made when the stopping portion 702 makes contact with the fire pit 102. The stopper 706 may be made of any material. As shown, the stopper 706 may extend through a hole defined by the stopping portion 702. In other examples, the stopper 706 may be adhered or fixed to the inner side of the stopping portion 702.

FIG. 7 also shows a section view of one of the bottom support members (e.g., 402*a*) of the bottom support 402. The bottom support member 402*b* is welded to the connector 404. Another of the bottom support members 402*c* (hidden by the shield 302) is attached to the connector 404 by the fastener 700. In some examples, portions of the frame 200 may be welded together prior to shipping the product to a customer, while other portions of the frame 200 are assembled after the product is shipped. This can help to minimize packaging and shipping costs. For example, as shown, one of the bottom support members 402*b* is welded to the connector 404 while another of the bottom support members 402*c* is fastened to the connector 404 by the fastener 700. Sometimes, bottom support members 402*b*, 402*c* are welded to the connector 404 and sometimes both bottom support members 402*b*, 402*c* are separable from and can be fastened to the connector 404 using other methods.

Opposing ends (not shown) of the bottom support members 402*b*, 402*c* are connected to different connectors 404. In some examples, the bottom support 402 may be hollow. The cross section of the bottom support member 402*b* may be rectangular as shown, circular, or any other shape. The hollow nature of the bottom support 402 reduces the weight of the fire pit barrier 104, but also furthers the goal of reducing heat transfer. An inner side 708 of the bottom support member 402*b* is spaced from an outer side 710, as shown by arrows 712. Because the inner side 708 is spaced from the outer side 710, the gas within the bottom support 402 will transfer heat at a slower rate than if the component was solid. The spacing between the inner side 708 and the outer side 710 may also act to form the gap between opposing sides of the shield 302.

Like the top portion of the shield, the bottom portion of the shield 302 may have the interior side 620 spaced from the exterior side 622 as shown by the arrows 624. As with the top portion of the shield, the spacing between the two sides of the shield at the bottom portion minimizes heat transfer from the interior side 620 to the exterior side 622. Even if the fire pit 102 were to warm the interior side 620, that heat is not passed to the exterior side 622 because the of the air or other gas between the two sides.

Figure 8:
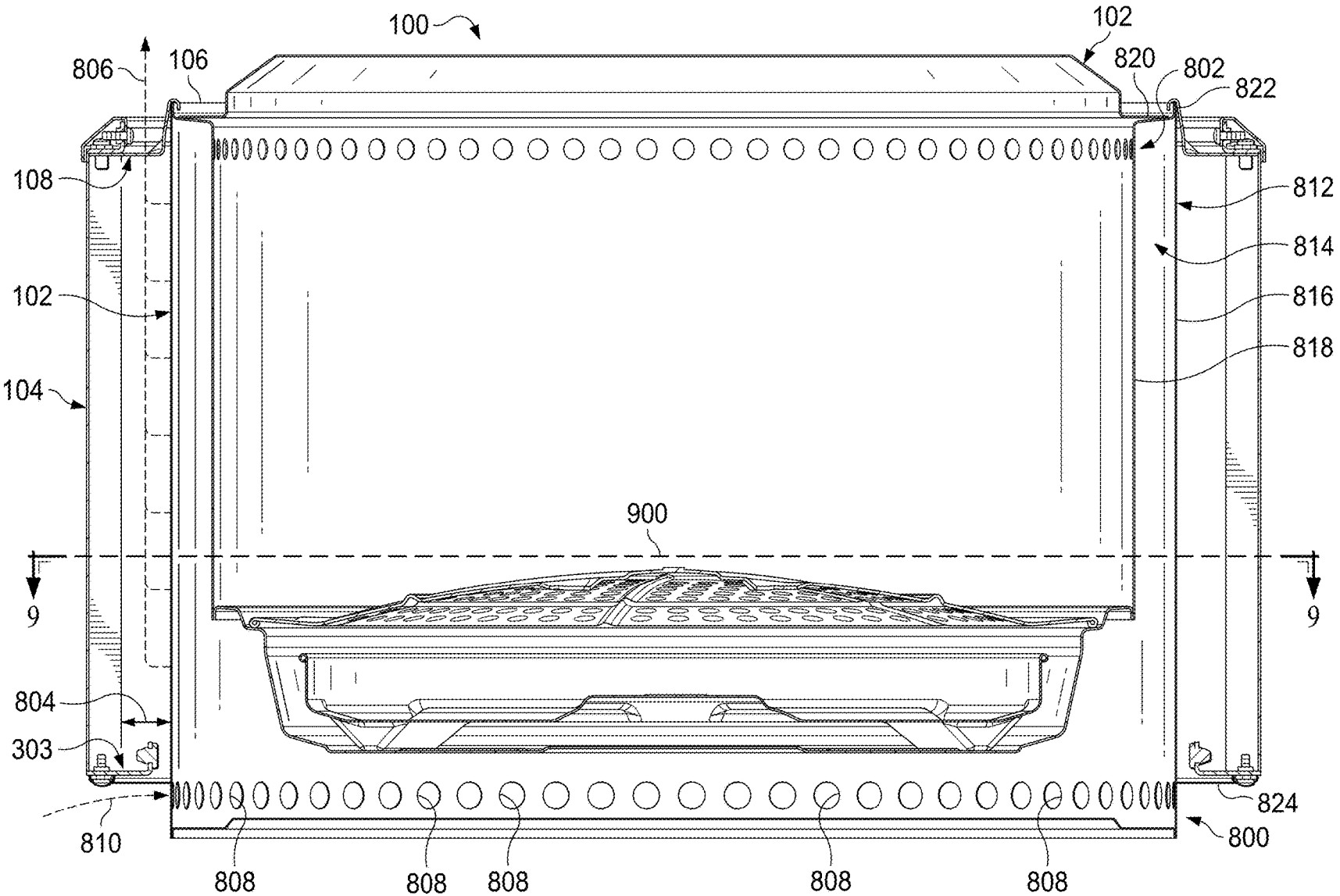
FIG. 8 is a side section view of a fire pit system, according to examples of the present disclosure.

FIG. 8 shows a section view of the fire pit system 100. The fire pit 102 includes a hollow wall 812 defining an upwardly open combustion cavity 814 therein. The hollow wall 812 includes an outer sidewall 816, an inner sidewall 818, a top surface 820 connecting or otherwise extending over the outer sidewall 816 and the inner sidewall 818. In this implementation, the top surface 820 includes a lip 822 projecting upward. Here, the hook 606 of the bracket 108 attaches to the top surface 820 of the hollow wall by attaching to the lip 822. However, the bracket 108 may attach to the top surface or otherwise be hung or suspended in any of a variety of manners.

The section view in FIG. 8 shows the spacing between the fire pit 102 and the fire pit barrier 104. For the reasons and structure of the fire pit barrier 104 described above, the fire pit barrier 104 is not in contact with the fire pit 102, which may reduce the likelihood of external objects coming into contact with a perimeter portion of the fire pit 102. Importantly, the space, shown by arrows 804 between the fire pit 102 and the fire pit barrier 104 minimizes heat transfer from the fire pit 102 to the fire pit barrier 104. The air and gas which is present in the space acts as a form of insulation, helping control the temperature of the fire pit barrier 104. As the fire pit 102 emits heat, the heat is able to escape through the space between the fire pit 102 and the fire pit barrier 104 into the environment, as shown by heat flow path 806.

In some examples, the fire pit 102 defines a plurality of holes 808 in the lower portion 800. The plurality of holes 808 facilitate air intake, supplying oxygen to the fire, as shown by an airflow path 810. An advantage provided by the fire pit system 100 described herein is that the fire pit barrier 104 does not inhibit the functionality of the holes 808. In this way, the fire pit barrier 104 does not stop air from traveling along the airflow path 810 beneath the shield 302 for intake into the lower portion 800 of the fire pit 102. To accomplish this, the height of the fire pit barrier 104 may be smaller than the height of the fire pit 102. Thus, as can be seen, a lower edge 824 of the barrier is at an elevation above the intake holes 808. Furthermore, because the brackets 108 allow the fire pit barrier to be coupled to or hung from the edge 106, the fire pit barrier 104 may not come into contact with the surface upon which the fire pit 102 is positioned.

Figure 9:
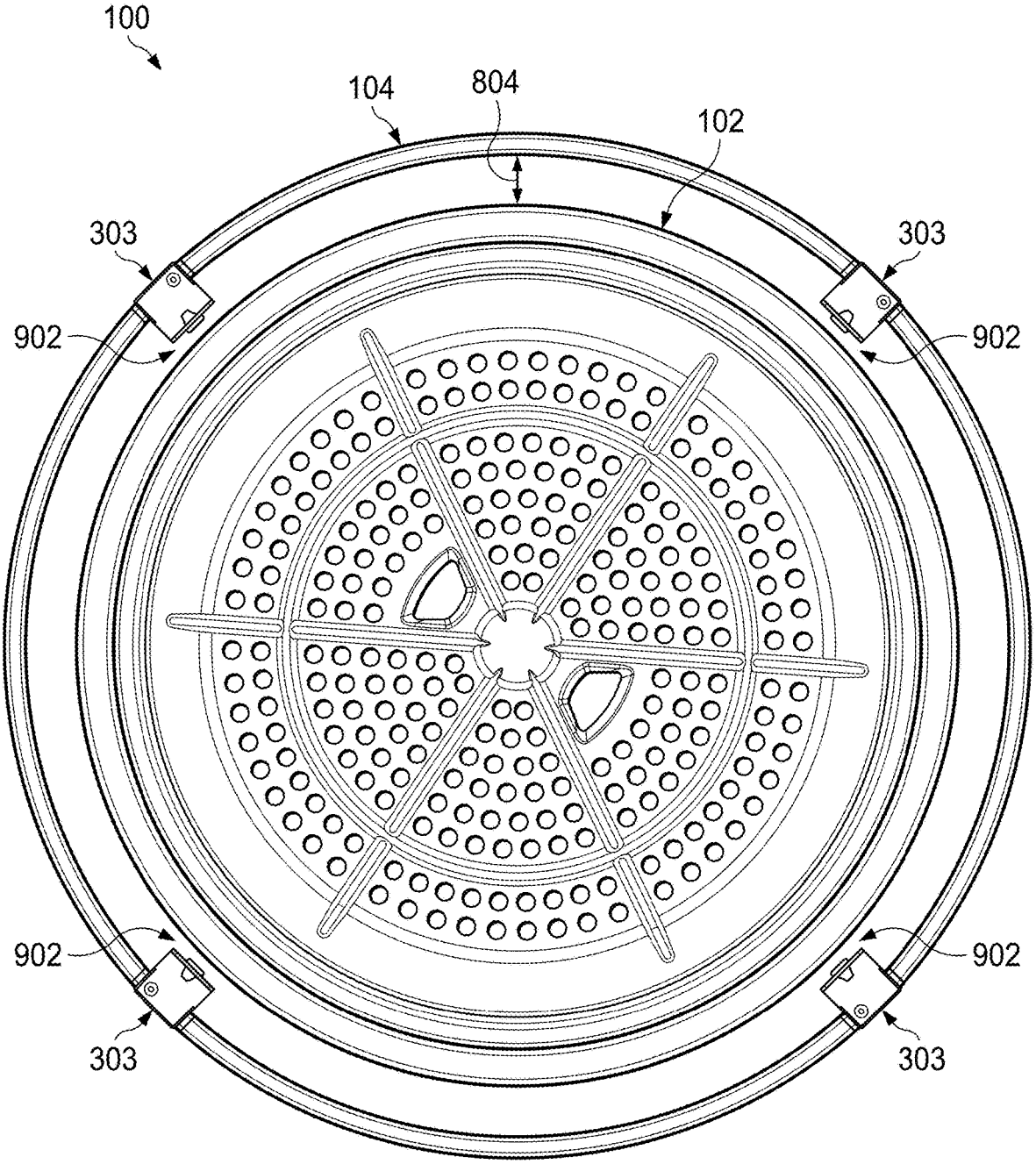
FIG. 9 is a top section view of a fire pit system, according to examples of the present disclosure.

FIG. 9 is a top section view of the fire pit system 100. The section view is taken from the viewpoint indicated by arrows 900 (shown in FIG. 8). This view clearly shows the spacing between the fire pit 102 and the fire pit barrier 104 when the fire pit barrier 104 is coupled to and hanging from the fire pit 102. The spacing is indicated by the arrows 804.

This view also shows the spacing between the spacers 303 and the sides of the fire pit 102. This spacing may be present when the width W1 (see FIG. 7) of the spacing portion 704 is less than the width W2 (see FIG. 6) of the spacing portion 610. This gap or space 902 may be of varying dimensions, depending on the fire pit system 100.

Figure 10:
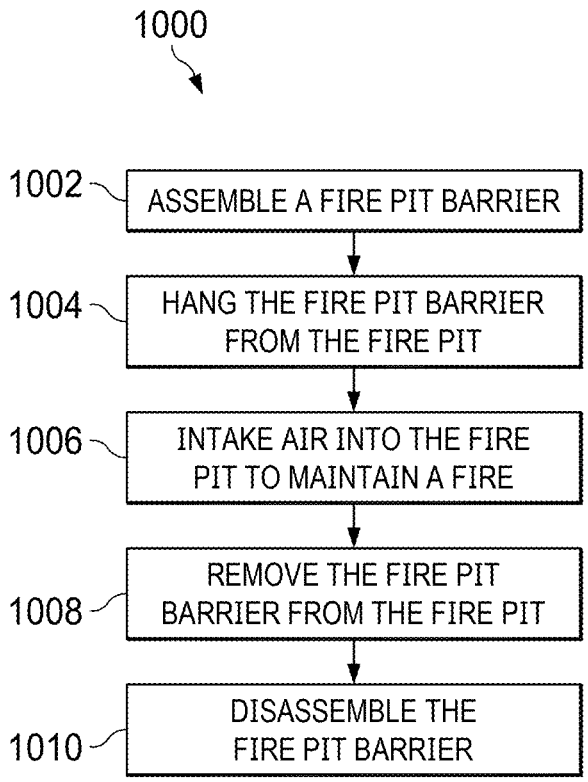
FIG. 10 is an illustrative method for comfortable use of a fire pit system without inhibiting functionality, according to examples of the present disclosure.

FIG. 10 shows an example of a method 1000 for enhancing the comfort of a fire pit, without inhibiting functionality. While FIG. 10 shows illustrative operations according to one example, other examples may omit, add to, reorder, and/or modify any of the operations shown in FIG. 10. Furthermore, other methods may incorporate other principles and aspects described throughout this disclosure.

A process 1002, in some examples, includes assembling the fire pit barrier 104. Assembling the fire pit barrier may include fastening components of the frame 300 together. Furthermore, assembling may include attaching the shield 302 to the frame 300. The connectors 404 may extend between the top support 400 and the bottom support 402. During assembly of the fire pit barrier 104, the bottom support members may be inserted into openings in the sections of the shield 302, thereby coupling the shield 302 to the frame. Similarly, when the frame 300 includes the bottom support 402, the bottom support members may be inserted into openings in the section so the shield 302, thereby coupling the shield 302 to the bottom support 402 of the frame 300.

A process 1004, in some examples, includes hanging the fire pit barrier 104 from the edge 106 or another lip, surface, or feature of the fire pit 102. The process 1004 does not require that the fire pit barrier 104 be hung from the fire pit 102. Rather, the fire pit barrier can be attached, rather than hung, by other methods including fastening, coupling, adhering, etc. In some examples, the fire pit barrier 104 is hung from the fire pit 102 using the one or more brackets 108 coupled to the frame 300. The bracket 108 may have a hook. By attaching the fire pit barrier 104 to the fire pit 102, the fire pit barrier 104 is spaced from the fire pit 102 to reduce the likelihood people, objects, or animals from contacting the fire pit 102. In some examples, the fire pit barrier 104 is configured to minimize heat transfer from the fire pit 102 to the exterior side 622 of the shield.

A process 1006, in some examples, includes intaking air into the fire pit 102 to maintain a fire within the fire pit 102. The air which is taken into the fire pit 102 may flow beneath the shield 302 and into the plurality of holes 808 defined in the bottom portion of the fire pit 102. An advantage of the fire pit barriers 104 described herein is that they can minimize the dangers that fire pits present while allowing the fire pit 102 to function efficiently. In this way, the fire pit 102 is still able to intake air and operate at high temperatures for the purpose of reducing smoke, among other purposes, while the fire pit barrier 104 still reduces the likelihood of contact with the hot surfaces.

A process 1008, in some examples, includes removing the fire pit barrier 104 from the fire pit 102 after the fire in the fire pit 102 extinguishes. An advantage of the design of the fire pit systems 100 described herein is that no tools or separable components may be required to install the fire pit barrier 104 on the fire pit 102. For example, one can hang the fire pit barrier 104 from the fire pit 102 simply by aligning the hook 606 of the bracket 108 with the edge 106. Removing the fire pit barrier 104 may be just as simple, and also may not require any tools or separable components. It is also contemplated that a handheld tool may be used to hang and remove the fire pit barrier 104 from the fire pit 102. Using a handheld tool may further increase the comfort of the fire pit system 100 and may allow one to remove the fire pit barrier 104 even while the fire pit 102 is still hot.

A process 1010, in some examples, includes disassembling the fire pit barrier. The process for disassembly may be a reversal of the steps described herein with respect to assembling the fire pit barrier 104. Disassembly may allow for convenient storage or washing of the fire pit barrier 104.

As shown, the fire pit 102 may be cylindrical and the fire pit barrier 104 may be correspondingly cylindrical. However, the disclosure herein is also applicable to fire pits of other shapes. For example, the fire pit 102 may be square or rectangular, among other shapes. Furthermore, the fire pit barrier 104 need not correspond to the shape of the fire pit 102. For example, a cylindrical fire pit could be protected by a square shaped fire pit barrier. Furthermore, although the fire pit 102 is a portable fire pit, the examples described herein apply to any other type of fire pit as well.

The methods and operations described above can be applied to the fire pit systems 100 as described herein. All of the features of the fire pit systems 100 may be applicable to the method 1000 and may enhance or add additional process to the method 1000. If the processes applied to the fire pit system 100, one can expect to benefit from many advantages including, but not limited to: reducing the likelihood of contact between people, objects and animals and the fire pit 102, minimizing heat transfer from the fire pit 102 to the exterior side 622 of the fire pit barrier 104, minimizing heat transfer from the interior side 620 of the fire pit barrier 104 to the exterior side 622 of the fire pit barrier 104, maintaining space between the fire pit barrier 104 and the fire pit 102, maximizing heat transfer from the fire pit barrier 104 to the environment, and providing the fire pit barrier 104 that allows for air to be taken into the fire pit 102. All of these advantages as well as further advantages discussed herein enhance the comfort of fire pits without inhibiting functionality, among other things.

The methods described herein are illustrated as a set of operations or processes. Not all of the illustrated processes may be performed in all examples of the methods. Additionally, one or more processes that are not expressly illustrated or described may be included before, after, in between, or as part of the example processes. In some examples, one or more of the processes may be performed by a controller and/or may be implemented, at least in part, in the form of executable code stored on non-transitory, tangible, computer or machine-readable media that when run by one or more processors may cause the one or more processors to perform one, some, or all of the processes described in relation to the methods herein. Elements illustrated in block diagrams herein may be implemented with hardware, software, firmware, or any combination thereof. One block element being illustrated separate from another block element does not necessarily require that the functions performed by each separate element requires distinct hardware or software but rather they are illustrated separately for the sake of description.

In some instances, well-known methods, procedures, and components have not been described in detail so as not to unnecessarily obscure aspects of the examples. While certain exemplary examples of the present disclosure have been described and shown in the accompanying drawings, it is to be understood that such examples are merely illustrative of and not restrictive on the broad disclosure herein, and that the examples of the present disclosure should not be limited to the specific constructions and arrangements shown and described, since various other modifications may occur to those ordinarily skilled in the art.

What is claimed is:

1. A fire pit barrier comprising:

a frame removably couplable to a fire pit, the frame comprising:

a top support;

a bottom support spaced apart from the top support; and at least one connector extending between the top support and the bottom support; and a shield coupled to the frame, the shield being configured to cover an outer surface of the fire pit.

2. The fire pit barrier of claim 1, further comprising at least one bracket extending radially inwardly from the frame, the at least one bracket being configured to hang the fire pit barrier from an edge of the fire pit.

3. The fire pit barrier of claim 2, further comprising at least one spacer extending inwardly to maintain space between the fire pit and the shield.

4. The fire pit barrier of claim 3, wherein a width of the at least one spacer is less than a width of the at least one bracket such that the at least one spacer is not in contact with the fire pit when the fire pit barrier hangs from the fire pit in equilibrium.

5. The fire pit barrier of claim 1, wherein the fire pit barrier is configured to allow air to flow past a bottom portion of the shield for intake into a lower portion of the fire pit.

6. The fire pit barrier of claim 1, wherein the shield has an interior side and an exterior side spaced from the interior side in a manner forming an insulative gap.

7. The fire pit barrier of claim 1, wherein a plurality of holes extending through the at least one connector dissipate heat from the frame to an environment radially outward of the shield.

8. The fire pit barrier of claim 1, further comprising a grille positioned atop the frame, wherein the grille defines a plurality of holes to dissipate heat from the frame to an environment radially outward of the shield, and wherein the grille is configured to protect the at least a portion of the shield from radiant heat, infrared heat, direct heat, or any combination thereof.

9. A fire pit barrier comprising:

a frame couplable to a fire pit, the frame comprising:

a top support;

a bottom support spaced apart from the top support; and at least one connector extending between the top support and the bottom support; and a shield coupled to the frame, the shield being configured to cover an outer surface of the fire pit and reduce the likelihood of contact with the outer surface of the fire pit, wherein the top support includes a plurality of top support members extending laterally between top portions of the at least one connector, and wherein the bottom support includes a plurality of bottom support members extending laterally between bottom portions of the at least one connector.

10. The fire pit barrier of claim 9, wherein the shield includes a plurality of sections, each of the plurality of sections coupled to one of the top support members and one of the bottom support members, and wherein the shield is flexible and heat resistant.

11. A fire pit system comprising:

a fire pit having an upper portion, a lower portion, and an external surface forming a fire pit perimeter; and a fire pit barrier sized to extend about the fire pit perimeter, the fire pit barrier comprising:

a frame comprising a bracket extending from the fire pit barrier and removably couplable to the upper portion of the fire pit in a manner causing the fire pit barrier to removably hang from the fire pit; and a shield supported by the frame and disposed to be spaced apart from the external surface.

12. The fire pit system of claim 11, wherein the fire pit barrier is further configured to cover an outer surface of the fire pit and allow air to flow past a bottom portion of the shield for intake into the lower portion of the fire pit.

13. The fire pit system of claim 11, wherein the fire pit barrier further comprises at least one bracket including a hook configured to hang the fire pit barrier from an edge of the upper portion of the fire pit.

14. The fire pit system of claim 11, wherein the shield is spaced from the fire pit to maximize heat transfer from the fire pit to an environment vertically above the fire pit barrier and to minimize heat transfer from the fire pit to the shield.

15. The fire pit system of claim 11, wherein the shield has an interior side spaced from an exterior side to minimize heat transfer from the interior side to the exterior side.

16. The fire pit system of claim 11, wherein a plurality of holes extending through the frame dissipate heat from the frame to an environment radially outward of the shield.

17. The fire pit system of claim 11, wherein the fire pit barrier is configured to rest on the fire pit for unconstrained removal from the fire pit.

18. A method comprising:

assembling a fire pit barrier by attaching a shield to a frame, the frame comprising:

a top support;

a bottom support; and connectors extending between the top support and the bottom support;

hanging the fire pit barrier from an edge of a fire pit using at least one bracket extending between the frame and the fire pit, the fire pit barrier configured to inhibit heat transfer from the fire pit to an environment radially outward of the shield; and removing the fire pit barrier from the fire pit after a fire extinguishes.

19. The method of claim 18, further comprising intaking air into the fire pit to maintain the fire, the air flowing beneath the shield.

20. The method of claim 18, wherein the at least one bracket is positioned near the top support and extends inwardly from the frame, and wherein at least one spacer is positioned near the bottom support and extends inwardly from the frame.

21. A fire pit barrier comprising:

a frame having at least one connector configured to engage a fire pit in manner that removably suspends the frame from the fire pit; and a shield coupled to the frame, wherein the shield is made of a non-metallic material, and wherein an interior side of the shield is spaced apart from an outer surface of the fire pit.

22. The fire pit barrier of claim 21, further comprising at least one bracket extending radially inwardly from the frame, the at least one bracket being configured to hang the fire pit barrier from an edge of the fire pit.

23. The fire pit barrier of claim 22, further comprising at least one spacer extending inwardly from the frame or shield to maintain space between the fire pit and the shield.

24. The fire pit barrier of claim 21, wherein the frame comprises a top support and a bottom support, the top support and the bottom support being spaced apart, wherein the shield is a fabric extending between the top support and the bottom support to cover the outer surface of the fire pit.

25. The fire pit barrier of claim 24, wherein the fabric is a sleeve extending about both the top support and the bottom support.

* * * * *